US008511091B2

(12) United States Patent
Goodwin

(10) Patent No.: US 8,511,091 B2
(45) Date of Patent: Aug. 20, 2013

(54) SWIRLER FOR A FUEL INJECTOR

(75) Inventor: Martin S. Goodwin, Loughborough (GB)

(73) Assignee: Rolls-Royce PLC, London (GB)

( * ) Notice: Subject to any disclaimer, the term of this patent is extended or adjusted under 35 U.S.C. 154(b) by 1056 days.

(21) Appl. No.: 12/461,021

(22) Filed: Jul. 29, 2009

(65) Prior Publication Data

US 2010/0050647 A1 Mar. 4, 2010

(30) Foreign Application Priority Data

Sep. 1, 2008 (GB) ..... 0815761.2

(51) Int. Cl.
*F02C 1/00* (2006.01)
*F02G 3/00* (2006.01)
*F23R 3/26* (2006.01)

(52) U.S. Cl.
USPC ..... 60/772; 60/39.23; 60/741; 60/748; 239/570; 239/571; 239/583; 137/115.13; 137/115.15

(58) Field of Classification Search
USPC ..... 60/39.23, 737, 740, 741, 742, 743, 60/748, 772, 776; 239/463, 501, 570, 571, 239/583; 137/110, 115.13, 115.14, 115.15, 137/115.16, 115.17, 115.26, 535, 540, 809, 137/812, 813; 251/126
See application file for complete search history.

(56) References Cited

U.S. PATENT DOCUMENTS 1,781,236 A * 11/1930 Lilge ..... 431/352
3,476,134 A * 11/1969 Kemp ..... 137/115.13
3,570,522 A * 3/1971 Horsch et al. ..... 137/115.03
3,765,171 A * 10/1973 Hagen et al. ..... 60/39.23
3,869,246 A * 3/1975 Hammond et al. ..... 431/351
4,006,589 A * 2/1977 Schirmer ..... 60/748
4,044,553 A * 8/1977 Vaught ..... 60/39.23
4,255,927 A * 3/1981 Johnson et al. ..... 60/39.23
4,270,562 A * 6/1981 Oberth et al. ..... 137/115.16
4,430,860 A * 2/1984 Melchior et al. ..... 60/606
4,447,010 A * 5/1984 Maeda et al. ..... 239/414
4,754,600 A * 7/1988 Barbier et al. ..... 60/39.23
4,861,263 A * 8/1989 Schirmer ..... 431/158
4,913,181 A * 4/1990 Mortenson ..... 137/12
4,921,547 A * 5/1990 Kosarzecki ..... 137/115.09
5,323,799 A * 6/1994 Pengler ..... 137/115.14
5,333,459 A * 8/1994 Berger ..... 60/723
5,548,951 A * 8/1996 Mumford et al. ..... 60/39.23
5,605,287 A * 2/1997 Mains ..... 239/402
5,664,412 A * 9/1997 Overton ..... 60/39.23
5,704,386 A * 1/1998 Lehmann et al. ..... 137/115.13

(Continued)

FOREIGN PATENT DOCUMENTS

GB 2 085 147 A 4/1982
JP A-11-270808 10/1999

*Primary Examiner* — Ted Kim
*Assistant Examiner* — Michael B Mantyla
(74) *Attorney, Agent, or Firm* — Oliff & Berridge, PLC

(57) ABSTRACT

A swirler is provided for a fuel injector of a combustor of a gas turbine engine. The swirler is for directing an airflow into the combustor so as to atomize fuel exiting the fuel injector. The swirler has one or more passages for channelling the airflow. Each of the passages is configured to rotate the airflow channelled by that passage about a swirl axis of the swirler, such that on exiting the passage the airflow has an exit swirl angle and a direction of rotation relative to the swirl axis. The swirler is configured such that the exit swirl angle and/or the direction of rotation may be selectively varied.

21 Claims, 2 Drawing Sheets

(56) References Cited

U.S. PATENT DOCUMENTS 5,807,094 A * 9/1998 Sarv ..... 431/177
6,199,367 B1 * 3/2001 Howell ..... 60/39.23
6,263,663 B1 * 7/2001 Grienche et al. ..... 60/794
6,474,569 B1 * 11/2002 Brundish et al. ..... 239/406
7,281,529 B2 * 10/2007 Lew et al. ..... 123/568.12
7,363,756 B2 4/2008 Carrea et al.

* cited by examiner

SWIRLER FOR A FUEL INJECTOR

BACKGROUND OF THE INVENTION

The present invention relates to swirlers for the fuel injectors of combustors of gas turbine engines and in particular to swirlers for the fuel injectors of lean burn combustors of a gas turbine engine.

Fuel injection systems deliver fuel to the combustion chamber of an engine, where the fuel is thoroughly mixed with air before combustion. One form of fuel injection system well-known in the art is a fuel spray nozzle. Fuel spray nozzles atomise the fuel to ensure its rapid evaporation and burning when mixed with air.

An airblast atomiser nozzle is a type of fuel spray nozzle in which fuel delivered to the combustion chamber by a fuel injector is aerated by swirlers to ensure rapid mixing of fuel and air, and to create a finely atomised fuel spray. The swirlers impart a swirling motion to air entering the combustion chamber, so as to create a high level of shear in the fuel flow.

Typically, an airblast atomiser nozzle will have a number of swirlers. An annular fuel passage between a pair of swirlers feeds fuel onto a pre-filming lip. Thus a sheet of fuel is formed that breaks down into ligaments. These ligaments are then broken up into droplets within the shear layers of the surrounding highly swirling air, to form the fuel spray stream that is emitted from the fuel injection system.

One type of fuel injection system that may have airblast atomiser nozzles is a lean burn fuel injector. A typical lean burn injector 100 is shown in FIG. 2 and is in general circularly symmetrical about a central axis (or swirl axis) 101. A central pilot airblast fuel injector 102 is positioned on this axis 101. Inner and outer pilot swirlers 104,106 are located radially inwards and radially outwards of the pilot fuel injector 102 respectively. The pilot fuel outlet 108 is positioned downstream of the inner and outer pilot swirlers 104,106 and between the inner and outer pilot airflows. These airflows promote atomisation of the fuel injected into the combustion chamber at the pilot fuel injection point 108.

An annular mains airblast fuel injector 110 is located radially outwards of the pilot fuel injector 102. Inner and outer mains swirlers 112,114 are located radially inwards and radially outwards of the mains fuel injector 110 respectively, and provide a swirling airflow for atomisation of the fuel injected at the mains fuel outlet 116.

When the gas turbine engine is operating at low power, only the pilot fuel injector is activated. As engine power is increased, some of the mains fuel supplies are activated, until at high power the mains and pilot fuel injectors are both fully active.

The configuration of the inner and outer swirlers of an airblast fuel injector plays a role in controlling the efficient mixing of air and fuel and so influences the smoke emissions and NOx emissions from the burning fuel.

SUMMARY OF THE INVENTION

There is a continuing need to enhance the performance of gas turbine engines of the type used to power jet aircraft or generate electricity, and thus it is desirable to improve the design of fuel injection systems, such as airblast atomiser nozzles, to achieve improved control of smoke and NOx emissions from the combustion chamber.

In general terms, the present invention provides a swirler for a fuel injector of a combustor of a gas turbine engine, which is configured so that the angle and/or angular direction of the swirling motion imparted by the swirler to the air entering the combustion chamber may be selectively varied.

In a first aspect, the present invention provides a swirler arrangement for a fuel injector of a gas turbine engine, the swirler arrangement having a plurality of passages for channelling airflow through the swirler and into a combustor, each of the passages having an inlet, the arrangement having a plug movable between a first position in which the inlet to one of said passages is open and a further position where another of said passages is open, wherein the arrangement has a pressurisable chamber for receiving a fluid, the pressure of the fluid in the chamber in use providing motive force to move the plug between the first and further position.

The role of a swirler is to atomise the fuel injected into a combustor, so as to provide efficient mixing of fuel and air. By providing a variable swirler that can direct airflow into the combustor in such a way that the swirl angle and/or direction of rotation of the airflow exiting the swirler may be selectively varied, it is possible to control the process of mixing air and fuel within the combustor more closely, and thus to maintain smoke and/or NOx emissions within desirable limits.

Typically, each of the one or more passages follows a helical path relative to the swirl axis of the swirler. In this case, the path followed by the passage or passages may have an axial component that is aligned with the swirl axis and a further component that is tangential relative to the swirl axis. In general, the helical path followed by each of the one or more passages corresponds to less than one complete turn around the swirl axis.

Airflow exiting one of these passages generally follows a helical path having a helical angle that corresponds to the exit swirl angle and an angular direction that corresponds to the direction of rotation.

Typically, the swirler of the present invention is part of a fuel injection system and provides one of a pair of swirlers for swirling air past a fuel injector. For example, the swirler of the present invention may be an inner swirler for a pilot fuel injector, the pilot fuel injector also having an outer swirler. This outer swirler may itself be a variable swirler according to the present invention or a conventional, fixed-angle swirler.

By pairing the variable swirler of the present invention with a second swirler, it may be possible to vary the interaction of the airstreams exiting each swirler, so as to vary the parameters of the shear flow around the fuel injection point of the fuel injector. Thus the atomisation of the fuel and the mixing of fuel and air may be controlled more closely and smoke and/or NOx emissions maintained within desirable limits.

Typically, the variable swirler of the present invention is configured so that the direction of rotation of the airflow into the combustor may be varied from clockwise to anti-clockwise. That is, the angular direction of the path followed by the airflow exiting the swirler may be varied between a first angular direction and a second angular direction that is opposed to the first angular direction.

In this case, the variable swirler may be paired with a second swirler, so that the operation of the two swirlers may be selectively varied from co-swirl (in which both swirlers direct air in the same angular direction) to counter-swirl (in which the swirlers direct air in opposing angular directions).

It has been found that co-swirl operation of a pair of swirlers, e.g. the inner and outer pilot swirlers, may result in low smoke emissions at low power (e.g. when only the pilot fuel injector is active), but high NOx emissions at high power (e.g. when both the pilot and mains fuel injectors are active).

By contrast, it has been found that counter-swirl operation of a pair of swirlers, e.g. the inner and outer pilot swirlers, may result in low NOx emissions at high power, but high smoke emissions at low power.

By pairing a variable swirler according to the present invention with another swirler, it may be possible to operate the swirlers in co-swirl mode at low power and counter-swirl mode at high power, in order to maintain smoke and NOx emissions at desirably low levels throughout a broad operational range of the gas turbine engine.

It is thought that the variation in smoke emissions and NOx emissions during co-swirl and counter-swirl operation is related to the different shapes of the fuel spray stream emitted by the pilot fuel injector during these two modes of operation.

It is thought that during co-swirl operation, the pilot fuel spray stream has a significant radially outward flare in the downstream direction. This provides the pilot fuel spray stream with a frustoconical shape having a relatively large cone angle. The shape of the fuel spray stream promotes efficient combustion of the fuel, resulting in low smoke emission. However, at high power settings, when the mains fuel injector is also active, the pilot fuel spray stream tends to interact strongly with the air flow from the mains fuel injector, resulting in high NOx emissions.

By contrast, it is thought that during counter-swirl operation, the pilot fuel spray stream is narrower than that produced during co-swirl operation, i.e. the fuel spray stream has a frustoconical shape having a relatively small cone angle. The shape of the fuel spray stream results in less efficient combustion of the fuel spray stream than is the case for co-swirl operation, resulting in higher smoke emission. At high power levels, the pilot fuel spray stream interacts less strongly with the mains fuel spray stream than is the case for co-swirl operation, resulting in lower NOx emissions.

In order to provide a selectively variable path for the airflow into the combustor, the swirler of the present invention may include a first and a second passage. The two passages may be configured such that the swirl angle and/or direction of rotation of air exiting each passage is different. The exit swirl angle and/or direction of rotation of the airflow may then be controlled by directing the airflow through a selected one of the first and second passages. Typically, in this case, the first and second passages are configured to rotate the airflow in opposing angular directions.

The selection of the first or second passage for directing the airflow into the combustor may be effected by a plug that is movable between a first position, in which it blocks the entrance to the second passage, so that the airflow is channelled through the first passage and a second position, in which the plug blocks the entrance to the first passage, so that the airflow is channelled through the second passage.

Movement of the plug is preferably effected by the pressure of fluid within a pressurisable chamber. The fluid is preferably a hydrocarbon mixture that is used for fuel in the gas turbine engine. The plug may be biased into a first position by a resilient member with the bias being overcome by the pressure of the fuel.

The variable swirler of the invention may include a control mechanism for varying the exit swirl angle and/or direction of rotation of the airflow in response to the power generated by the combustor. When the variable swirler is paired with a second swirler (variable or conventional), this control mechanism may allow the mode of operation of the two swirlers to be changed from e.g. co-swirl at low power to e.g. counter-swirl at high power.

Typically, the control mechanism is configured to respond to changes in the pressure of said combustor.

In a second aspect, the present invention may provide a fuel injection system including a fuel injector and the swirler of the first aspect of the invention, for swirling air past the fuel injector. Typically, the fuel injector is an airblast fuel injector, and in general, the swirler is concentric with the fuel injector. The swirler may be integral with the fuel injector, that is, the passages of the swirler may pass through the body of the fuel injector.

The fuel injection system may comprise a pilot and a mains fuel injector, the swirler of the first aspect of the invention being for swirling air past the pilot fuel injector. By varying the angle and/or angular direction of swirl of a swirler associated with a pilot fuel injector, it may be possible to maintain smoke emissions and NOx emissions within desirable limits during both low power and high power operation of a gas turbine engine.

The swirler of the first aspect of the invention may be disposed radially inwardly or radially outwardly of the fuel injector, but is preferably disposed radially inwardly. In particular, the swirler may be disposed radially inwardly of a pilot fuel injector.

Typically, the swirler is one of a pair of swirlers, both swirlers being for directing a respective airflow past the fuel injector. The pair of swirlers may both be variable swirlers according to the first aspect of the invention. Alternatively, one swirler of the pair of swirlers may be a conventional swirler for directing airflow according to a fixed exit swirl angle and direction of rotation.

In a third aspect, the present invention may provide a lean burn combustor having a fuel injection system according to the second aspect of the invention.

In a fourth aspect, the present invention may provide a gas turbine engine having a fuel injection system according to the second aspect of the invention.

BRIEF DESCRIPTION OF THE DRAWINGS

Embodiments of the invention will now be described by way of example with reference to the accompanying drawings in which.

DETAILED DESCRIPTION OF THE DRAWINGS

Figure 1A:
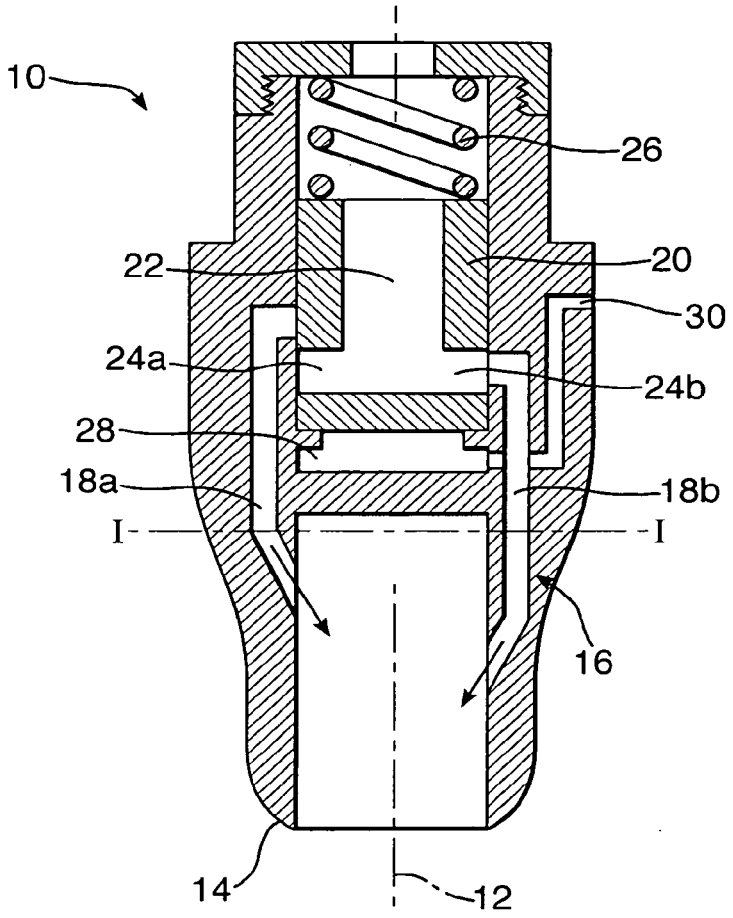
FIG. 1(*a*) shows a schematic longitudinal cross-sectional view of a fuel injector having a swirler according to an embodiment of the invention, and FIG. 1(*b*) shows a schematic transverse cross-sectional view of the fuel injector on the plane I-I.
Figure 1B:
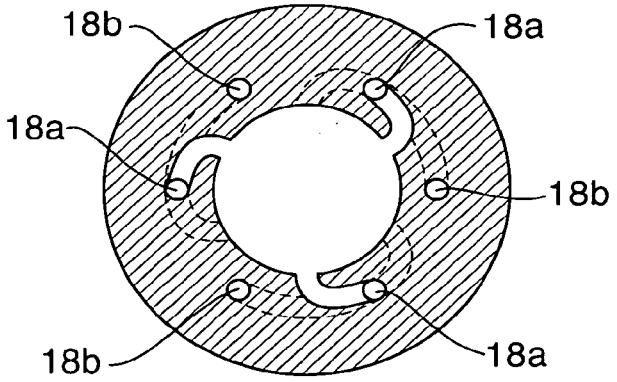
Figure 2:
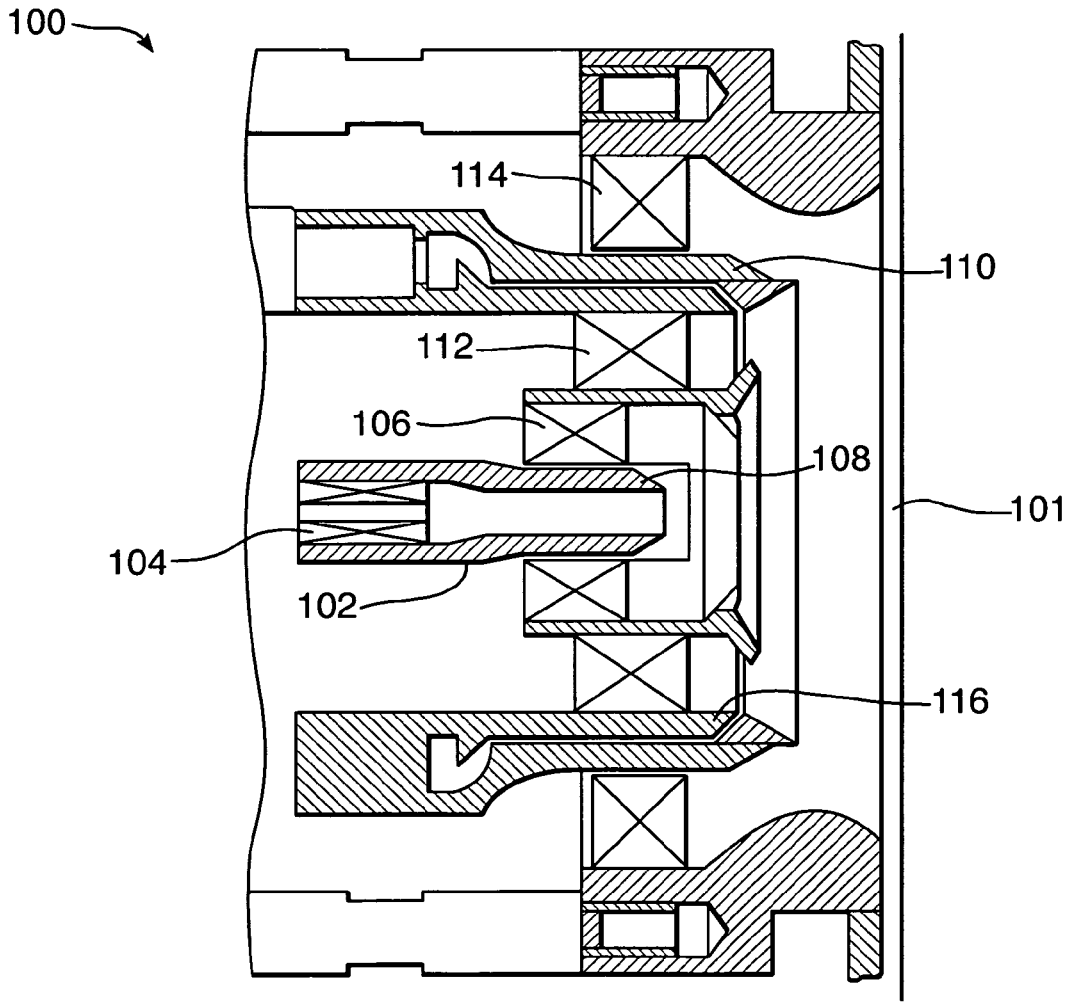
Fig.2. (Related Art)
FIG. 2 shows a schematic longitudinal cross-sectional view of a known fuel injection system.

FIG. 1(*a*) shows a pilot airblast fuel injector 10 having a swirler according to an embodiment of the present invention. The pilot airblast fuel injector 10 typically forms part of a fuel injection system that is in general circularly symmetrical about a central axis 12. The pilot airblast fuel injector typically lies along this central axis 12. The fuel injection system generally also includes a mains airblast fuel injector (not shown), situated radially outwards from the pilot fuel injector 10.

The fuel injection system is generally mounted on the upstream wall of a combustor, i.e. at the head of a flame tube of the combustion chamber of a gas turbine engine.

The pilot fuel injector 10 has an annular fuel outlet (not shown) at the downstream end 14 of the injector. Liquid fuel is provided to this outlet and forms a film across the downstream end 14. An inner swirler 16 and an outer swirler (not shown) are provided on the radially inward and outward sides of the fuel injector 10, respectively. In this embodiment, the inner swirler 16 is integrally formed with the body of the pilot fuel injector 10, and the swirl axis of the inner swirler coincides with the central axis 12. However, in other embodiments, the inner swirler and the fuel injector may be separate compoments.

The inner and outer swirlers direct an airflow into the combustor and supply rapidly moving and swirling air to the region adjacent the downstream end 14 of the fuel injector 10. These air streams cause the annular film of liquid fuel to be atomised into small droplets, thus creating a fuel spray stream.

The inner swirler 16 includes swirl passages 18*a*,18*b* for channelling an airflow into the combustor. Each of the swirl passages 18*a*,18*b* has an entrance that extends radially relative to the central axis 12, while the remainder of the passage follows a helical path relative to the central axis 12 of the fuel injection system. Since the inner swirler 16 is integrally formed with the body of the pilot fuel injector 10, the passages 18*a*,18*b* pass through the pilot fuel injector.

Similarly, the outer swirler, disposed radially outwards of the pilot fuel injector 10 has swirl passages that channel an airflow into the combustor. Each of the swirl passages follows a helical path relative to the central axis 12 of the fuel injection system.

The inner and outer swirlers channel the respective airflow of each swirler along a helical path. This helical path has an axial component that is aligned with the central axis 12 and a further component that is tangential relative to the central axis 12. Thus, the inner and outer swirlers condition the motion of the airflow into the combustor to generate helical flow.

Thus, when exiting the swirler, the airflow follows a path having an exit swirl angle and direction of rotation that have been imparted by the swirler.

The swirl passages of the inner swirler are divided into two sets. A first set of swirl passages 18*a* follow a right-handed (i.e. clockwise) helical path, while a second set of swirl passages 18*b* follow a left-handed (i.e. anti-clockwise) helical path. That is, the helical angle of the first set of swirl passages 18*a* is equal in magnitude but opposite in sign to the helical angle of the second set of swirl passages 18*b*, i.e. the first and second sets of swirl passages 18*a*, 18*b* have opposing angular directions.

More specifically, as shown in FIG. 1(*b*), which is a schematic transverse cross-sectional view on the plane I-I of FIG. 1(*a*), there are three circumferentially spaced swirl passages 18*a*, and three circumferentially spaced swirl passages 18*b*, the swirl passages 18*a* alternating with the swirl passages 18*b* around the circumference of the inner swirler.

The upstream entrance to the first set of swirl passages 18*a* is axially displaced from the upstream entrance to the second set of swirl passages 18*b*.

A sliding cylindrical plug 20 provided within the inner swirler 16 has a main channel 22 extending along the central axis 12 of the fuel injection system. The main channel 22 is in fluid communication with further channels 24*a*,24*b* provided within the plug that extend from the main channel 22 in a radial direction. The radially-extending channels 24*a,b* include three channels 24*a* that extend in the same radial directions as the entrances to the first set of swirl passages 18*a*, and three channels 24*b* that extend in the same radial directions as the entrances to the second set of swirl passages 18*b*.

The plug 20 has a first axial position in which the first set of channels 24*a* is in fluid communication with the first set of swirl passages 18*a*, while the entrance to the second set of swirl passages 18*b* is blocked.

The plug 20 also has a second axial position, in which it is axially displaced from the first axial position and in which the second set of channels 24*b* is in fluid communication with the second set of swirl passages 18*b*. In this case, the entrance to the first set of swirl passages 18*a* is blocked by the plug.

When the plug 20 is in its first axial position, airflow into the inner swirler 16 is directed along the main channel 22 of the plug, through the channels 24*a* and along the first set of swirl passages 18*a*. Thus, the airflow is directed along a right-handed (i.e. clockwise) helical path, and exits the swirler with a clockwise direction of rotation.

Similarly, when the plug 20 is in its second axial position (shown in FIG. 1), airflow into the inner swirler 16 is directed along the main channel 22 of the plug, through the channels 24*b* and along the second set of swirl passages 18*b*. Thus, the airflow is directed along a left-handed (i.e. anti-clockwise) helical path, and exits the swirler with an anti-clockwise direction of rotation.

The plug 20 is resiliently biased to the second axial position by means of a spring 26 disposed at the upstream end of the plug 20.

The resilient bias of the spring is countered by the pressure within a pressure compartment 28 provided within the fuel injector 10 at the downstream end of the plug 20. The pressure compartment 28 is in fluid communication with a signal line connected to the fuel supply system.

When the signal line is above a predetermined pressure, typically while the combustor is operating at high power, the plug 20 will tend to be located at the first axial position and the airflow into the inner swirler 16 will be directed along a right-handed (i.e. clockwise) helical path.

By contrast, when the signal line is lower than a predetermined pressure, the plug 20 will tend to be located at the second axial position and the airflow into the inner swirler 16 will be directed along a left-handed (i.e. anti-clockwise) helical path.

The predetermined pressure that overcomes the bias of the spring is preferably similar to the pressure that is required to open the valves which supply the fuel to the main injector. Thus, as the fuel begins to flow to the main injector the cylindrical plug will be moved to position 1 by the pressure of the fuel to vary the exit swirl angle and rotation direction of the air through the pilot injector.

It is alternatively possible to use the fuel supply to the pilot injector to pressurise the pressure compartment since both the pilot fuel pressure and main fuel pressure increases with power demand from the engine.

Thus the sliding cylindrical plug 20, spring 26, pressure compartment 28 and conduit 30 provide a passive control mechanism responsive to changes in the pressure of the fuel supply for varying the exit swirl angle and rotation direction.

The helical angle and angular direction of the helical path followed by the passages of the outer swirler may be fixed. In this case, the fuel injection system may be operated such that the inner and outer swirlers operate in co-swirl mode, i.e. both swirlers direct airflow into the combustor along a clockwise helical path or both swirlers direct airflow along an anti-clockwise helical path, such that the angular direction of the helical flow generated by the two swirlers is the same. Alternatively, by changing the axial position of the plug 20 in the inner swirler 16, the fuel injection system may be operated such that the inner and outer swirlers operate in counter-swirl mode, e.g. the inner swirler directs airflow along a clockwise helical path, while the outer swirler directs airflow along an anti-clockwise helical path, such that the angular direction of the helical flow generated by the inner swirler is opposite to that generated by the outer swirler.

Co-swirl operation of the inner and outer swirlers tends to result in relatively low smoke emissions at low power, but high NOx emissions at high power. By contrast, counter-swirl operation of the inner and outer swirlers tends to result in high smoke emissions at low power, but low NOx emissions at high power.

In this embodiment of the invention, the direction of rotation of the airflow exiting the inner swirler of the pilot fuel injector may be varied from clockwise to anti-clockwise. Thus, during operation of a fuel injection system according to this embodiment of the invention, the mode of operation of the inner and outer swirlers of the pilot fuel injector may be changed from co-swirl to counter-swirl, according to the need to reduce either smoke or NOx emissions. Typically the mode of operation will be changed from co-swirl to counter-swirl as the combustor changes from a low-power state to a high-power state.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention as claimed.

The invention claimed is:

1. A swirler arrangement for a fuel injector of a gas turbine engine, the swirler arrangement comprising:

a plurality of passages for channeling airflow through the swirler arrangement and into a combustor, each of the passages having an inlet, and a plug movable between a first position and a second position, wherein at the first position the inlet to a first passage of said plurality of passages is open and the inlet to a second passage of said plurality of passages is closed, and at the second position the inlet to the second passage of said plurality of passages is open and the inlet to the first passage of the plurality of passages is closed, the swirler arrangement has a pressurisable chamber for receiving a fluid, the pressure of the fluid in the chamber in use providing motive force to move the plug between the first and second position, and the first passage of the plurality of passages is for channeling said airflow such that on exiting said first passage said airflow has a first exit swirl angle and a first direction of rotation relative to a swirl axis, and the second passage of the plurality of passages is for channeling said airflow such that on exiting said second passage said airflow has a second exit swirl angle and a second direction of rotation relative to said swirl axis.

2. A swirler arrangement according to claim 1, wherein said first passage rotates said airflow along a clockwise path and said second passage rotates said airflow along an anti-clockwise path.

3. A swirler arrangement according to claim 1, wherein each passage is disposed along a helical path relative to the swirl axis of the swirler arrangement.

4. A swirler arrangement according to claim 1, in which said plug is positioned to block the entrance to said first passage of the plurality of passages and said airflow is channeled through said second passage of the plurality of passages.

5. A swirler arrangement according to claim 1, comprising a control mechanism for varying the exit swirl angle and/or the direction of rotation of said airflow in response to the power generated by said combustor.

6. A swirler arrangement according to claim 5, wherein said control mechanism controls the supply of fluid to the pressurisable chamber.

7. A swirler arrangement according to claim 1, wherein the fluid is fuel.

8. A swirler arrangement according to claim 1, wherein the plug is resiliently biased to the first position.

9. A swirler arrangement according to claim 1, wherein the plug is located within a bore with the inlet of each passage opening to the bore.

10. A swirler arrangement according to claim 9, wherein the bore has a closed end and the pressurisable chamber is defined between an end of the plug and the closed end of the bore.

11. A swirler arrangement according to claim 10, wherein a spring acts against an opposing end of the plug.

12. A swirler arrangement according to claim 1, wherein the plug has a channel defined therein.

13. A fuel injection system comprising a fuel injector and a swirler arrangement according to claim 1 for swirling air past said fuel injector.

14. A fuel injection system according to claim 13, wherein said fuel injector is an airblast fuel injector.

15. A fuel injection system according to claim 13, wherein said swirler arrangement is concentric with said fuel injector.

16. A fuel injection system according to claim 13, wherein said fuel injector is a pilot fuel injector, said fuel injection system further comprising a mains fuel injector.

17. A fuel injection system according to claim 13, wherein said swirler arrangement is disposed radially inwardly of said fuel injector.

18. A gas turbine engine having a fuel injection system according to claim 13.

19. A method of adjusting the exit swirl angle and/or direction of rotation of an air flow through a swirler arrangement in a fuel injector for a gas turbine engine, the swirler arrangement having a body concentrically disposed about a movable plug and having a plurality of passages for channeling airflow through the swirler arrangement and into a combustor, the plurality of passages including a first passage and a second passage disposed along a helical path relative to an axis of the swirler arrangement, the method comprising:

supplying a fluid to a pressurisable chamber formed by the body and the plug, and moving the plug, via pressure from the fluid, from a first position at which air flows through the first passage in the swirler arrangement to a second position at which air flows through the second passage in the swirler arrangement, wherein at the first position at least one inlet to the first passage is open and at least one inlet to the second passage is closed, at the second position the at least one inlet of the first passage is closed and the at least one inlet of the second passage is open, and the exit swirl angle and/or direction of rotation of the air flow is adjusted in accordance with the first passage having a first exit swirl angle in a clockwise direction relative to the axis, and the second passage having a second exit swirl angle in an anticlockwise direction relative to the axis.

20. A method according to claim 19, wherein the fluid is a liquid hydrocarbon.

21. A swirler arrangement for a fuel injector of a gas turbine engine, the swirler arrangement having a body concentrically disposed about a movable plug, the body having a plurality of passages for channeling airflow through the swirler arrangement and into a combustor, each of the passages having an inlet, the plug being movable between a first position in which at least one inlet to a first of said passages is open and at least one inlet to a second of said passages is closed, and a second position in which the at least one inlet to the first of said passages is closed and the at least one inlet to the second of said passages is open, wherein the first and second of said passages are disposed along a helical path relative to an axis of the swirler arrangement, the first of said passages having a first exit swirl angle in a clockwise direction relative to the axis, and the second of said passages having a second exit swirl angle in an anticlockwise direction relative to the axis, wherein the body and plug form a pressurisable chamber for receiving a fluid, the pressure of the fluid in the chamber in use providing motive force to move the plug between the first and second positions.

* * * * *